US010252534B2

(12) United States Patent
Satake et al.

(10) Patent No.: US 10,252,534 B2
(45) Date of Patent: Apr. 9, 2019

(54) RECORDING HEAD RECOVERY SYSTEM AND INKJET RECORDING APPARATUS THEREWITH, AND METHOD FOR RECOVERING RECORDING HEAD

(71) Applicant: KYOCERA Document Solutions Inc., Osaka (JP)

(72) Inventors: Kenichi Satake, Osaka (JP); Yasutaka Inui, Osaka (JP); Takuma Araki, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/827,304

(22) Filed: Nov. 30, 2017

(65) Prior Publication Data

US 2018/0162133 A1 Jun. 14, 2018

(30) Foreign Application Priority Data

Dec. 13, 2016 (JP) ..... 2016-240904

(51) Int. Cl.
*B41J 2/165* (2006.01)

(52) U.S. Cl.
CPC ..... *B41J 2/16552* (2013.01); *B41J 2/16508* (2013.01); *B41J 2/16535* (2013.01); *B41J 2/16538* (2013.01); *B41J 2/16585* (2013.01); *B41J 2002/16558* (2013.01); *B41J 2002/16591* (2013.01)

(58) Field of Classification Search
CPC ..... B41J 2/16552; B41J 2/16538; B41J 2/16535; B41J 2002/16558; B41J 2002/1655
See application file for complete search history.

(56) References Cited

U.S. PATENT DOCUMENTS

2011/0074870 A1* 3/2011 Maida ..... B08B 3/02 347/28
2015/0217572 A1* 8/2015 Ohnishi ..... B41J 2/1652 347/28

FOREIGN PATENT DOCUMENTS

JP 2007-83496 A 4/2007

* cited by examiner

*Primary Examiner* — Geoffrey S Mruk
(74) *Attorney, Agent, or Firm* — Stein IP, LLC

(57) ABSTRACT

A recording head recovery system has a recording head, a tank, and a control portion. The control portion can perform a recovery operation of the recording head including a cleaning solution feeding operation where cleaning solution is fed through cleaning solution feed ports by locating the tank such that the solution surface of the cleaning solution in the tank is above a first position which is the height of the cleaning solution feed ports, a wiping operation where a wiper wipes an ink ejection surface, and a non-feeding operation where the cleaning solution is sucked into the cleaning solution feed ports by locating the tank such that the solution surface of the cleaning solution in the tank is below the first position.

6 Claims, 12 Drawing Sheets

RECORDING HEAD RECOVERY SYSTEM AND INKJET RECORDING APPARATUS THEREWITH, AND METHOD FOR RECOVERING RECORDING HEAD

INCORPORATION BY REFERENCE

This application is based upon and claims the benefit of priority from the corresponding Japanese Patent Application No. 2016-240904 filed on Dec. 13, 2016, the entire contents of which are incorporated herein by reference.

BACKGROUND

The present disclosure relates to a recording head recovery system having ink ejection ports through which ink is ejected onto a recording medium such as paper, to an inkjet recording apparatus provided with such a recording head recovery system, and to a method for recovering a recording head.

As a recording apparatus such as a facsimile machine, a copier, or a printer, an inkjet recording apparatus that forms images by ejecting ink is widely used for forming high-resolution images.

In such an inkjet recording apparatus, fine ink droplets (hereinafter, referred to as mist) ejected together with ink droplets for image recording and splashed mist generated when ink droplets attach to a recoding medium are settled and hardened on an ink ejection surface of a recording head. Gradually-increased mist on the ink ejection surface covers ink ejection ports, and leads to degraded straight-traveling performance (curved flying) of ink, ejection failure, and the like; this results in degraded printing performance of the recording head.

As a solution, an inkjet recording apparatus is known in which, for the purpose of cleaning an ink ejection surface of a recording head, a plurality of cleaning solution feed ports are provided in a part of the ink ejection surface outside (the upstream side in the wiping direction of a wiper) an ink ejection region where a plurality of ink ejection ports are open. In this inkjet recording apparatus, after cleaning solution has been fed through the cleaning solution feed ports, the wiper can, by being moved along the ink ejection surface from outward of the cleaning solution feed ports, wipe the ink ejection surface while holding the cleaning solution thereon. In this way, the process of recovering the recording head can be performed.

SUMMARY

According to one aspect of the present disclosure, a recording head recovery system includes a recording head, a tank, a cleaning solution feed passage, a lifting mechanism, and a control portion. The recording head has an ink ejection surface and a plurality of cleaning solution feed ports. In the ink ejection surface, a plurality of ink ejection ports through which ink is ejected onto a recording medium are open. The plurality of cleaning solution feed ports are arranged upstream of the ink ejection ports in the wiping direction in which a wiper wipes the ink ejection surface, and through the cleaning solution feed ports, cleaning solution is fed. The tank stores cleaning solution to be fed to the cleaning solution feed ports in the recording head. The air pressure in the interior space of the tank is kept equal to the atmospheric pressure. The cleaning solution feed passage connects between the tank and the cleaning solution feed ports. The lifting mechanism moves the tank in the up-down direction. The control portion controls the operation of the lifting mechanism. The control portion can perform a recovery operation of the recording head including a cleaning solution feeding operation where cleaning solution is fed through the cleaning solution feed ports by locating the tank such that the solution surface of the cleaning solution in the tank is above a first position which is the height of the cleaning solution feed ports, a wiping operation where, after the cleaning solution feeding operation, the wiper wipes the ink ejection surface while holding the cleaning solution thereon, and a non-feeding operation where, in the middle of or after the wiping operation, the cleaning solution is sucked into the cleaning solution feed ports by locating the tank such that the solution surface of the cleaning solution in the tank is below the first position.

Further features and advantages of the present disclosure will become apparent from the description of embodiments given below.

DETAILED DESCRIPTION

Hereinafter, an embodiment of the present disclosure will be described with reference to the accompanying drawings.

Figure 1:
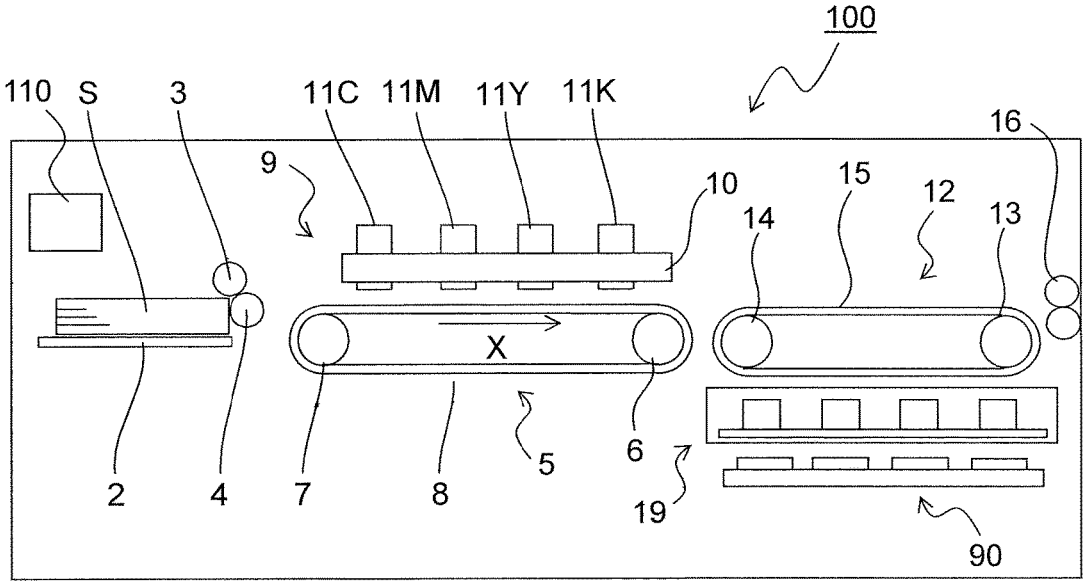
FIG. 1 is a diagram showing a structure of an inkjet recording apparatus incorporating a recording head according to one embodiment of the present disclosure.

As shown in FIG. 1, an inkjet recording apparatus 100 according to one embodiment of the present disclosure includes, in a left side part thereof, a sheet feed tray 2 which stores sheets S (a recording medium), and includes, at one end of the sheet feed tray 2, a sheet feeding roller 3 for conveying and feeding one sheet after another sequentially starting with the topmost sheet S out of the stored sheets S to a first conveying unit 5, which will be described later, and a following roller 4 which is kept in pressed contact with the sheet feeding roller 3 to rotate by following it.

On the downstream side (the right side in FIG. 1) of the sheet feeding roller 3 and the following roller 4 in the sheet conveyance direction (the direction indicated by arrow X), the first conveying unit 5 and a recording portion 9 are arranged. The first conveying unit 5 includes a first driving roller 6, a first driven roller 7, and a first conveyance belt 8 wound around the first driving roller 6 and the first driven roller 7. As the first driving roller 6 is driven to rotate in the clockwise direction according to a control signal from a control portion 110 in the inkjet recording apparatus 100, a sheet S held on the first conveyance belt 8 is conveyed in the direction indicated by arrow X.

Figure 2:
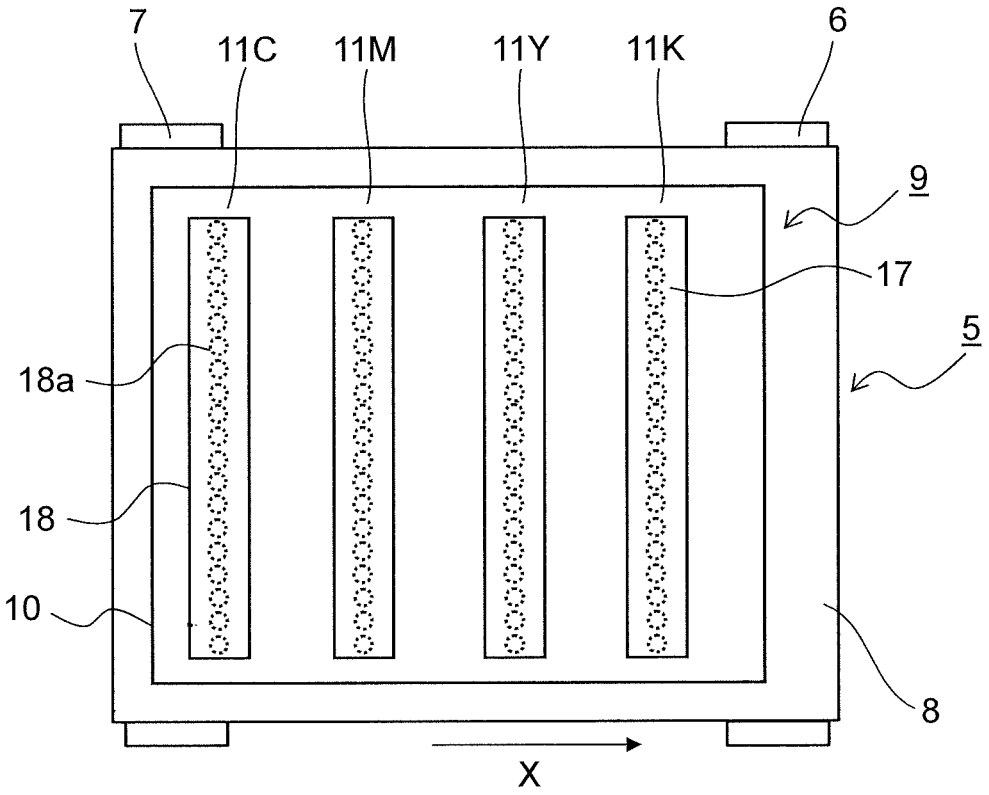
FIG. 2 is a top view of a first conveying unit and a recording portion in the inkjet recording apparatus shown in FIG. 1.

The recording portion 9 includes a head housing 10, and line heads 11C, 11M, 11Y, and 11K held on the head housing 10. These line heads 11C to 11K are supported at such a height as to form a predetermined gap (for example, 1 mm) from the conveyance surface of the first conveyance belt 8, and each have, as shown in FIG. 2, one or more (here, one) recording heads 17 extending in the sheet width direction (the up-down direction in FIG. 2) orthogonal to the sheet conveyance direction.

Figure 3:
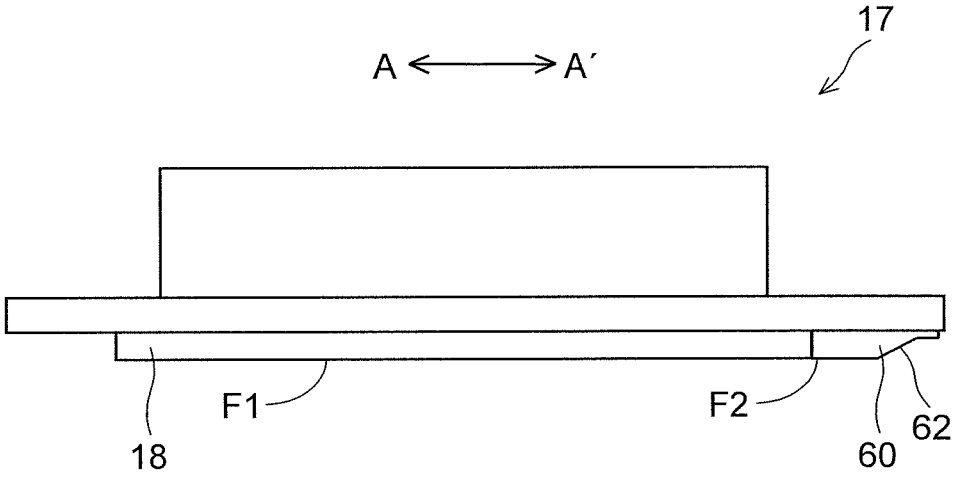
FIG. 3 is a diagram of a recording head constituting a line head of the recording portion.
Figure 4:
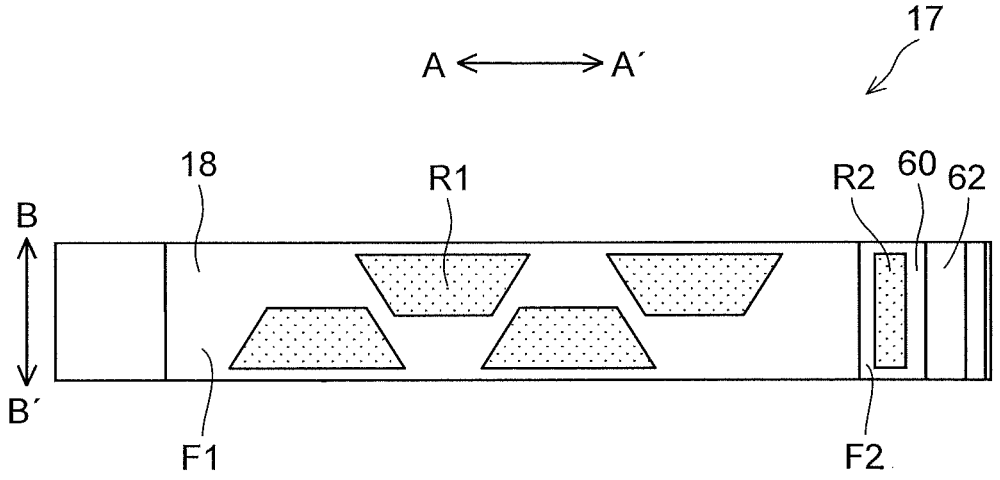
FIG. 4 is a diagram of the recording head as seen from the ink ejection surface side.

As shown in FIGS. 3 and 4, a head portion 18 of the recording head 17 has, on its ink ejection surface F1, an ink ejection region R1 in which a large number of ink ejection ports 18*a* (see FIG. 2) are arrayed.

The recording heads 17 constituting the line heads 110 to 11K are fed respectively with ink of four colors (cyan, magenta, yellow, and black) stored in respective ink tanks (unillustrated).

According to a control signal from the control portion 110 (see FIG. 1), based on image data received from an external computer or the like, each of the recording heads 17 ejects ink through the ink ejection ports 18*a* toward a sheet S conveyed in a state held by suction on the conveyance surface of the first conveyance belt 8. Thereby, on the sheet S on the first conveyance belt 8, a color image is formed that has ink of four colors, namely cyan, magenta, yellow, and black, overlaid together.

The recording head 17 includes a cleaning solution feeding member 60 which feeds cleaning solution. The cleaning solution feeding member 60 is arranged next to the head portion 18 on the upstream side (the right side in FIG. 3) thereof in the wiping direction of a wiper 35, which will be described later. The cleaning solution feeding member 60 has a cleaning solution feed surface F2 including a cleaning solution feed region R2 in which a large number of cleaning solution feed ports 60*a* (see FIG. 5) are arrayed through which cleaning solution is fed. At least the ink ejection surface F1 of the head portion 18 and at least the cleaning solution feed surface F2 of the cleaning solution feeding member 60 are formed of, for example, SUS (stainless steel).

The cleaning solution feed surface F2 is formed to be flush with the ink ejection surface F1. In an upstream-side (the right side in FIG. 3) part of the cleaning solution feeding member 60 with respect to the cleaning solution feed surface F2 in the wiping direction, an inclined surface 62 is formed.

Figure 5:
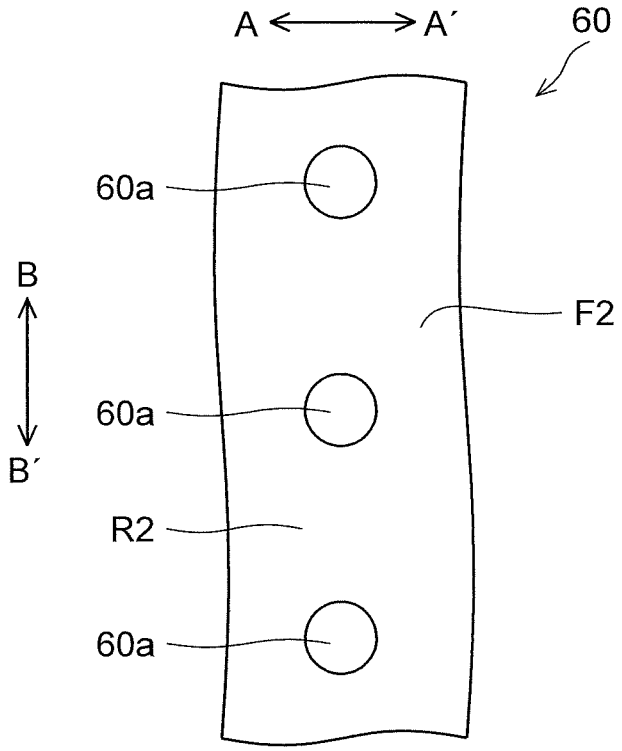
FIG. 5 is a bottom view of cleaning solution feed ports in a cleaning solution feeding member of the recording head.

As shown in FIG. 5, the cleaning solution feed ports 60*a* are arranged at a pitch of, for example, 1 mm along the head width direction (the direction indicated by arrows B and B', the direction orthogonal to the wiping direction). Although FIG. 5 only shows one row of a plurality of cleaning solution feed ports 60*a* arranged along the head width direction, a plurality of rows may be arranged next to each other in the wiping direction (the direction indicated by arrow A).

Figure 6:
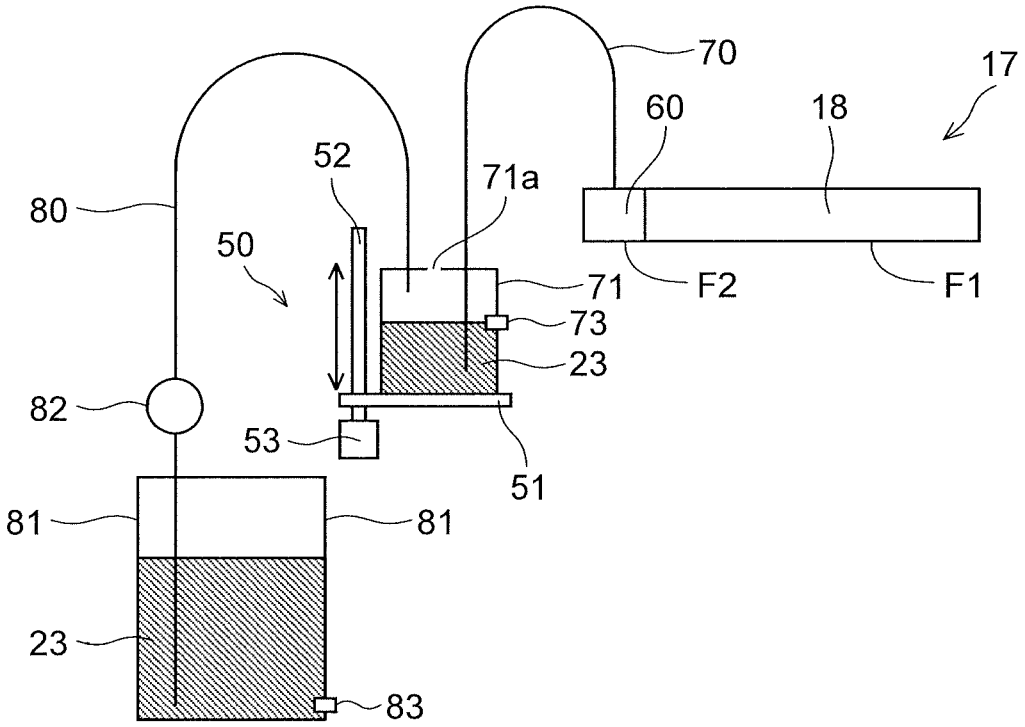
FIG. 6 is a diagram showing a structure around the recording head, a tank, and a supply tank.

As shown in FIG. 6, the cleaning solution feed port 60*a* (see FIG. 5) of the cleaning solution feeding member 60 is connected with the downstream end of a cleaning solution feed passage 70 formed by a tube through which cleaning solution 23 passes. The upstream part of the cleaning solution feed passage 70 is connected to a tank (also referred to as a sub-tank) 71 which stores the cleaning solution 23 to be fed to the cleaning solution feeding member 60. The upstream end of the cleaning solution feed passage 70 is immersed in the cleaning solution 23. The sub-tank 71 can be moved in the up-down direction by a lifting mechanism 50. In the drawings, to facilitate understanding, the cleaning solution 23 is indicated by hatching.

The sub-tank 71 is also connected with the downstream end of a cleaning solution supply passage 80 formed by a tube through which the cleaning solution 23 passes. The upstream end of the cleaning solution supply passage 80 is connected to a supply tank (also referred to as a main tank) 81 which stores the cleaning solution 23 to be supplied to the sub-tank 71. The upstream end of the cleaning solution supply passage 80 is immersed in the cleaning solution 23. The cleaning solution supply passage 80 is provided with a supply pump 82 which pumps up the cleaning solution 23 from the main tank 81 to feed it to the sub-tank 71. As the supply pump 82, for example, a tube pump, a syringe pump, a diaphragm pump, or the like can be used. The structures around the sub-tank 71, the main tank 81, and the lifting mechanism 50 will be described in detail later.

In this inkjet recording apparatus 100, to clean the ink ejection surfaces F1 of the recording heads 17, at the start of printing after a long pause and between printing operations, the cleaning solution 23 is fed through the cleaning solution feed ports 60*a* (see FIG. 5) to all the recording heads 17, and their ink ejection surfaces F1 are wiped by the wiper 35, which will be described later, in preparation for a subsequent printing operation.

Back in FIG. 1, on the downstream side (the right side in FIG. 1) of the first conveying unit 5 in the sheet conveyance direction, a second conveying unit 12 is arranged. The second conveying unit 12 includes a second driving roller 13, a second driven roller 14, and a second conveyance belt 15 wound around the second driving roller 13 and the second driven roller 14. As the second driven roller 13 is driven to rotate in the clockwise direction, a sheet S held on the second conveyance belt 15 is conveyed in the direction indicated by arrow X.

The sheet S having ink images recorded on it in the recording portion 9 is fed to the second conveying unit 12, and while it passes through the second conveying unit 12, the ink ejected onto the surface of the sheet S is dried. Under the second conveying unit 12, a maintenance unit 19 and a cap unit 90 are arranged. When wiping operation is performed by the above-mentioned wiper 35, the maintenance unit 19 moves to under the recording portion 9, where the maintenance unit 19 wipes off the cleaning solution 23 fed through the cleaning solution feed ports 60*a* in the recording heads 17 as well as purged ink, which will be described later, and collects the wiped cleaning solution 23 and purged ink. When capping the ink ejection surfaces F1 (see FIG. 3) of the recording heads 17, the cap unit 90 moves horizontally to under the recording portion 9, and then moves upward to be fitted on the bottom surfaces of the recording heads 17.

On the downstream side of the second conveying unit 12 in the sheet conveying direction, there is arranged a discharge roller pair 16 which discharges the sheet S having the images recorded on it out of the apparatus main body, and on the downstream side of the discharge roller pair 16, there is arranged a discharge tray (unillustrated) on which the sheet S discharged out of the apparatus main body is placed.

The maintenance unit 19 is composed of a plurality of wipers 35 (see FIG. 18) which are movable along the ink ejection surfaces F1, a substantially rectangular carriage (unillustrated) to which the plurality of wipers 35 are fixed, and a supporting frame (unillustrated) which supports the carriage. The carriage (unillustrated) is supported on the supporting frame (unillustrated) so as to be slidable in the direction indicated by arrows A and A'.

The wiper 35 is an elastic member (for example, a rubber member formed of EPDM) for wiping off the cleaning solution 23 fed through the cleaning solution feed ports 60*a* (see FIG. 5) of each recording head 17 to the cleaning solution feed surface F2. The wiper 35 is kept in pressed contact with an upstream-side part (here, the inclined surface 62) of the cleaning solution feeding member 60 with respect to the cleaning solution feed region R2 (see FIG. 4) in the wiping direction, and wipes, as the carriage (unillustrated) moves, the cleaning solution feed surface F2 and the ink ejection surface F1 in a predetermined direction (the direction indicated by arrow A).

Now, a detailed description will be given of the structures around the sub-tank 71, the main tank 81, and the lifting mechanism 50.

As shown in FIG. 6, at a predetermined position on the sub-tank 71, there is provided a first detection sensor 73 which detects the cleaning solution 23. The first detection sensor 73 has an electrode pair (unillustrated) that receives a voltage and that is arranged in the sub-tank 71. The first detection sensor 73 can detect the presence or absence of the cleaning solution 23 based on the presence or absence of an electric current between the electrodes. When the absence of the solution (the absence of an electric current) is detected by the first detection sensor 73, until the presence of the solution (the presence of an electric current) is detected, the supply pump 82 keeps supplying the cleaning solution 23 from the main tank 81 to the sub-tank 71. This permits the solution surface (top surface) of the cleaning solution 23 in the sub-tank 71 to be kept at a substantially constant height in the sub-tank 71.

In a lower part of the main tank 81, there is provided a second detection sensor 83 which detects the cleaning solution 23. The second detection sensor 83 has an electrode pair (unillustrated) that receives a voltage and that is arranged in the main tank 81. The second detection sensor 83 can detect the presence or absence of the cleaning solution 23 based on the presence or absence of an electric current between the electrodes. When the absence of the solution is detected by the second detection sensor 83, the display panel (unillustrated) of the inkjet recording apparatus 100 gives a notification that the main tank 81 is empty. This permits a user or an operator to replace the main tank 81 with a new one or to refill the main tank 81 with fresh cleaning solution 23.

The lifting mechanism 50 includes a placement board 51 on which the sub-tank 71 is placed, a ball screw 52 which is fitted with the placement board 51 and which extends in the up-down direction, and a stepping motor 53 which drives the ball screw 52 to rotate. As the stepping motor 53 rotates in the forward direction, the ball screw 52 rotates in the forward direction, and thus the placement board 51 moves up. As the stepping motor 53 rotates in the reverse direction, the ball screw 52 rotates in the reverse direction, and thus the placement board 51 moves down.

Figure 7:
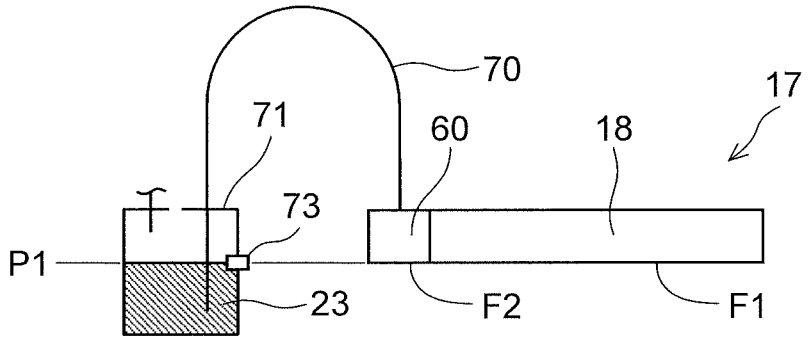
FIG. 7 is a diagram showing a state where the tank is located such that the solution surface of cleaning solution in the tank is at the same height as a first position.
Figure 8:
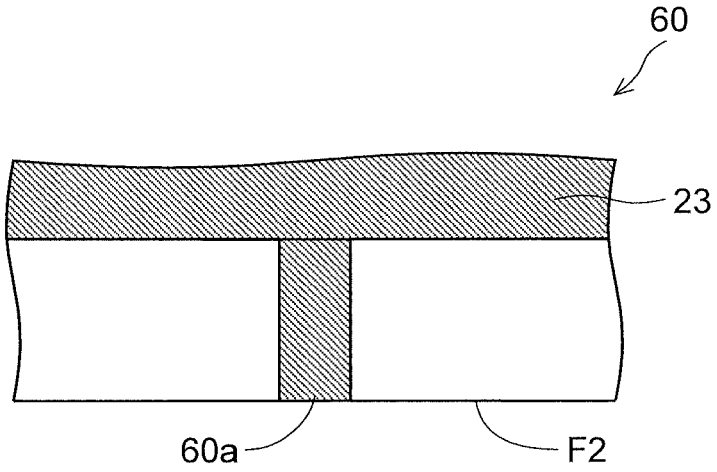
FIG. 8 is a diagram showing a state of the cleaning solution around a cleaning solution feed port in the state in FIG. 7.

In the sub-tank 71, there is provided an air opening 71*a* for keeping the air pressure in the interior space equal to the atmospheric pressure. Thus, when, as shown in FIG. 7, the sub-tank 71 is located such that the solution surface (top surface) of the cleaning solution 23 in the sub-tank 71 is at the same height as a first position P1 which is the height of the cleaning solution feed port 60*a*, then, as shown in FIG. 8, the solution surface (bottom surface) of the cleaning solution 23 in the cleaning solution feeding member 60 is flush with the cleaning solution feed surface F2.

When the sub-tank 71 is located such that the solution surface of the cleaning solution 23 in the sub-tank 71 is above the first position P1, the solution surface of the cleaning solution 23 in the cleaning solution feeding member 60 is formed below the cleaning solution feed surface F2 (below the cleaning solution ejection port 60*a*). On the other hand, when the sub-tank 71 is located such that the solution surface of the cleaning solution 23 in the sub-tank 71 is below the first position P1, the solution surface of the cleaning solution 23 in the cleaning solution feeding member 60 is formed above the cleaning solution feed surface F2 (above the cleaning solution feed port 60*a*). This will now be described more specifically.

The density of the cleaning solution 23 is represented by $\rho$ [kg/m$^3$], the surface tension coefficient of the cleaning solution 23 is represented by $\gamma$ [N/m], the gravitational acceleration is represented by g [m/s$^2$], the inner diameter of the cleaning solution feed port 60*a* is represented by $\phi$ [m], and the angle of contact of the cleaning solution 23 with respect to the cleaning solution feed surface F2 is represented by $\theta$ [rad]. The position higher than the first position P1 by $4\gamma \times \sin\theta/(\rho g \phi)$ is referred to as a second position P2, and the position lower than the first position P1 by $4\gamma/(\rho g \phi)$ is referred to as a third position P3.

Figure 9:
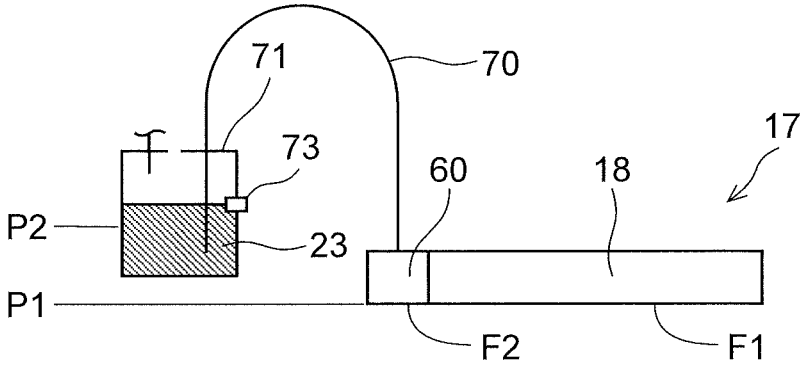
FIG. 9 is a diagram showing a state where the tank is located such that the solution surface of the cleaning solution in the tank is above a second position.
Figure 10:
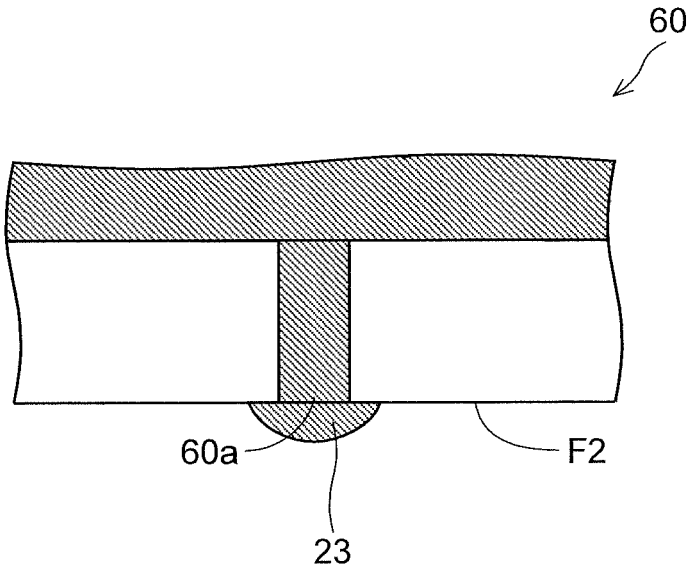
FIG. 10 is a diagram showing a state of the cleaning solution around the cleaning solution feed port in the state in FIG. 9.

In this case, when, as shown in FIG. 9, the sub-tank 71 is located such that the solution surface of the cleaning solution 23 in the sub-tank 71 is above the second position P2, then, as shown in FIG. 10, the solution surface of the cleaning solution 23 in the cleaning solution feeding member 60 is formed to spread onto the cleaning solution feed surface F2.

Figure 11:
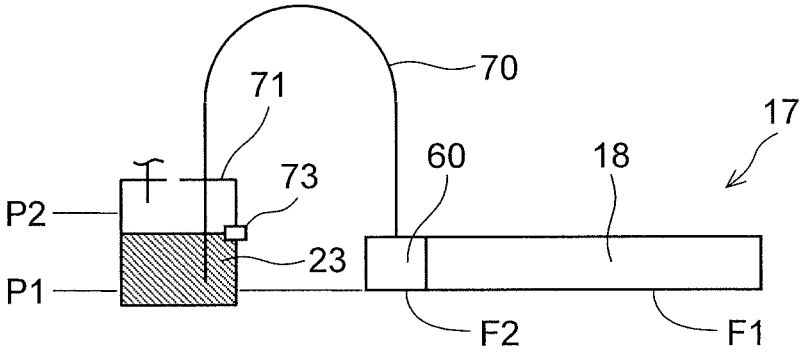
FIG. 11 is a diagram showing a state where the tank is located such that the solution surface of the cleaning solution in the tank is at a height higher than the first position but equal to or lower than the second position.
Figure 12:
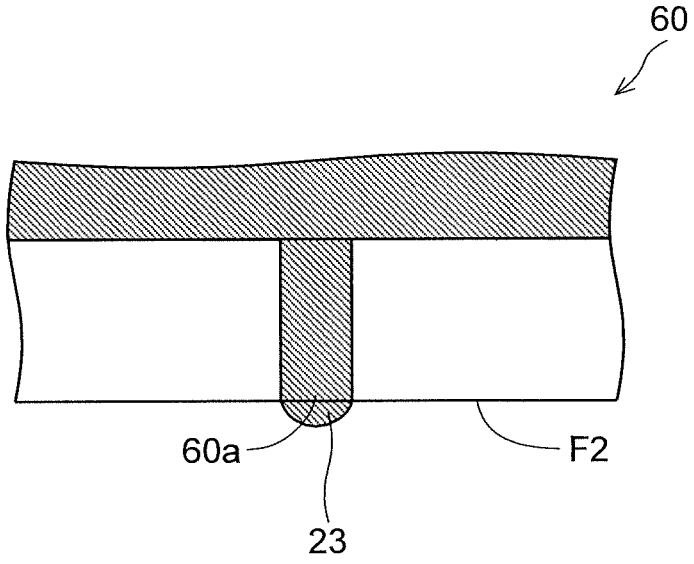
FIG. 12 is a diagram showing a state of the cleaning solution around the cleaning solution feed port in the state in FIG. 11.

When, as shown in FIG. 11, the sub-tank 71 is located such that the solution surface of the cleaning solution 23 in the sub-tank 71 is at a height higher than the first position P1 but equal to or lower than the second position P2, then, as shown in FIG. 12, the solution surface of the cleaning solution 23 in the cleaning solution feeding member 60 is formed below the cleaning solution feed surface F2 within the range of the cleaning solution feed port 60*a*.

Figure 13:
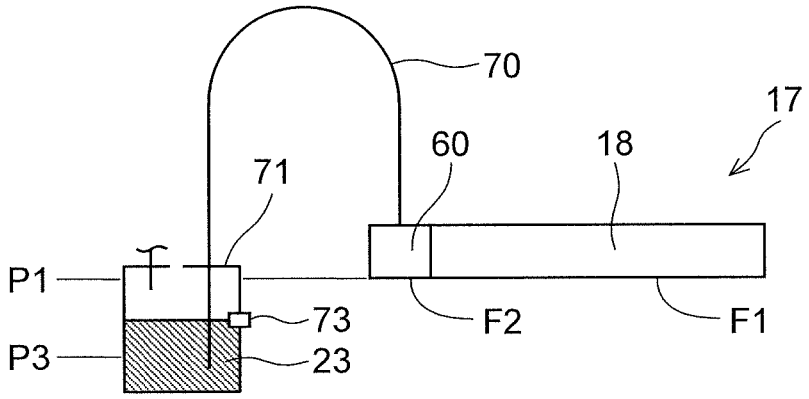
FIG. 13 is a diagram showing a state where the tank is located such that the solution surface of the cleaning solution in the tank is at a height lower than the first position but equal to or higher than the third position.
Figure 14:
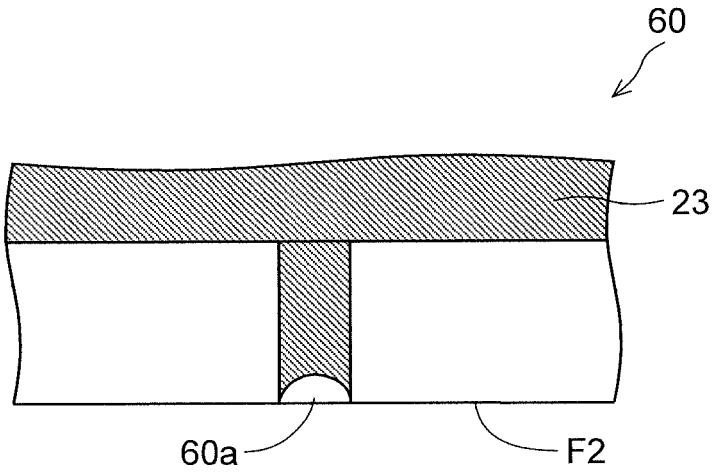
FIG. 14 is a diagram showing a state of the cleaning solution around the cleaning solution feed port in the state in FIG. 13.

When, as shown in FIG. 13, the sub-tank 71 is located such that the solution surface of the cleaning solution 23 in the sub-tank 71 is at a height lower than the first position P1 but equal to or higher than the third position P3, then, as shown in FIG. 14, the solution surface of the cleaning solution 23 in the cleaning solution feeding member 60 is formed above the cleaning solution feed surface F2 near the cleaning solution feed port 60*a*. That is, the cleaning solution 23 stays near the cleaning solution feed port 60*a* (near the cleaning solution feed surface F2).

Figure 15:
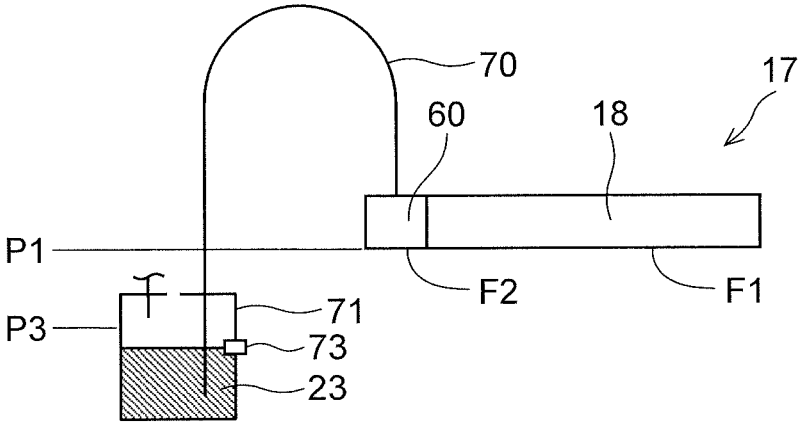
FIG. 15 is a diagram showing a state where the tank is located such that the solution surface of the cleaning solution in the tank is below the third position.
Figure 16:
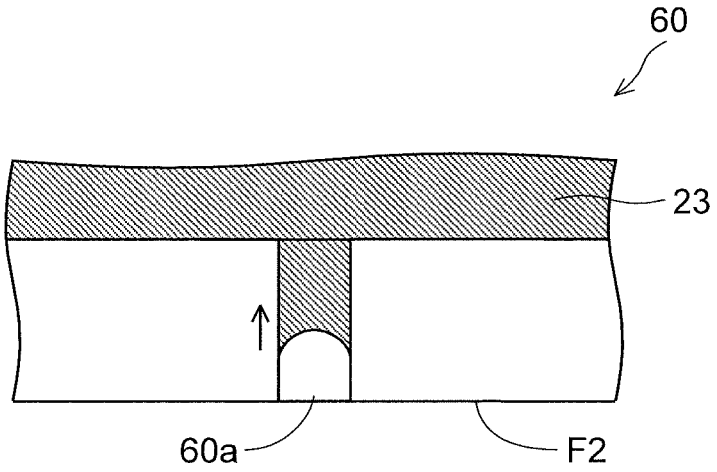
FIG. 16 is a diagram showing a state of the cleaning solution around the cleaning solution feed port in the state in FIG. 15.

When, as shown in FIG. 15, the sub-tank 71 is located such that the solution surface of the cleaning solution 23 in the sub-tank 71 is below the third position P3, then, as shown in FIG. 16, the cleaning solution 23 in the cleaning solution feeding member 60 flows back toward the sub-tank 71.

Next, a description will be given of a recovery operation of the recording heads 17 by use of the maintenance unit 19 in the inkjet recording apparatus 100 according to this embodiment. The recovery operation of the recording heads 17, which will now be described, is performed by controlling the operation of the recording heads 17, the maintenance unit 19, the lifting mechanism 50, and the like based on a control signal from the control portion 110 (see FIG. 1).

Figure 17:
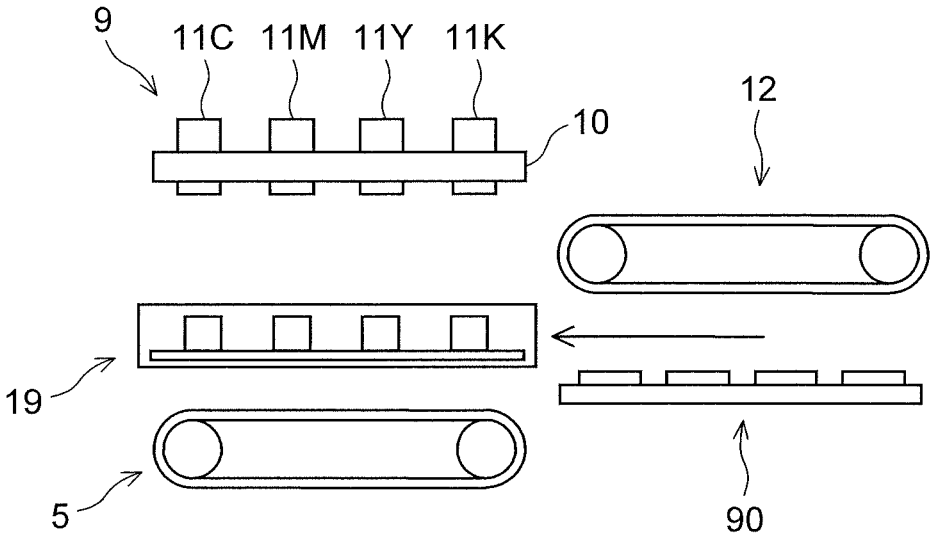
FIG. 17 is a diagram showing a state where a maintenance unit is located under the recording portion.

When the recovery operation of the recording heads 17 is performed, first, as shown in FIG. 17, the control portion 110 (see FIG. 1) moves down the first conveying unit 5 arranged under the recording portion 9. Then, the control portion 110 horizontally moves the maintenance unit 19 arranged under the second conveying unit 12 to locate it between the recording portion 9 and the first conveying unit 5. In this state, the wipers 35 (see FIG. 18) of the maintenance unit 19 are located below the ink ejection surfaces F1 and the cleaning solution feed surfaces F2 (see FIG. 3) of the recording heads 17. Here, the sub-tank 71 is located such that the solution surface of the cleaning solution 23 in the sub-tank 71 is below the first position P1 (here, at a height lower than the first position P1 but equal to or higher than the third position P3), and thus the solution surface of the cleaning solution 23 is in the state shown in FIG. 14.

Cleaning Solution Feeding Operation: Prior to a wiping operation, which will be described later, by the control portion 110 (see FIG. 1), the stepping motor 53 (see FIG. 6) of the lifting mechanism 50 is driven to rotate in the forward direction by a predetermined amount. Here, the sub-tank 71 is located such that the solution surface of the cleaning solution 23 in the sub-tank 71 is above the first position P1 (here, above the second position P2). Thus, as shown in FIG. 10, the solution surface of the cleaning solution 23 is formed to spread onto the cleaning solution feed surface F2.

Figure 18:
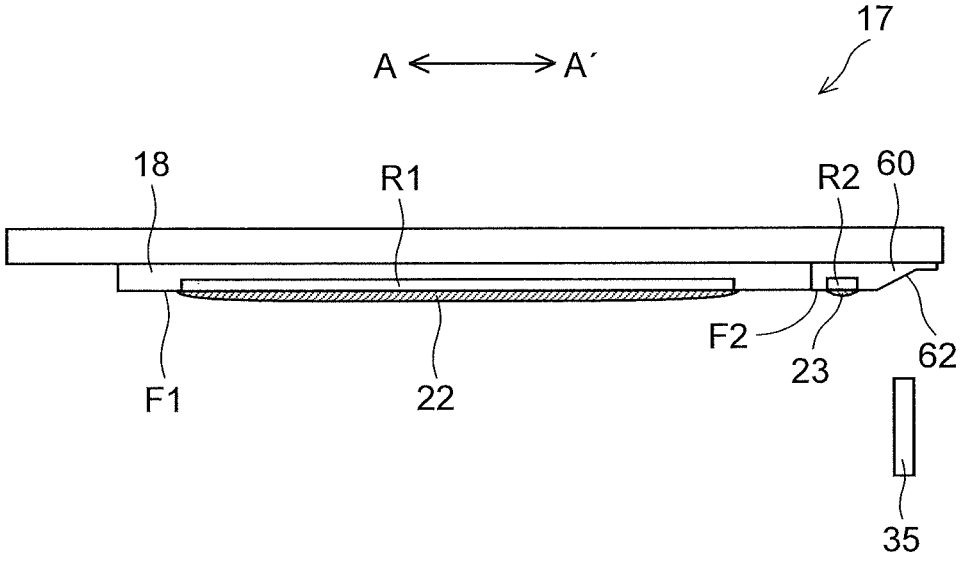
FIG. 18 is a diagram showing a state where a wiper is located under the recording head.

Ink Ejecting Operation: Prior to the wiping operation, which will be described later, as shown in FIG. 18, by the control portion 110 (see FIG. 1), ink 22 is fed to the recording head 17. The fed ink 22 is forcibly ejected (purged) from the ink ejection ports 18*a*. Through this purging operation, ink with high viscosity, foreign matter, and bubbles in the ink ejection ports 18*a* are discharged out of the ink ejection ports 18*a*. Here, the purged ink 22 is ejected onto the ink ejection surface F1 along the shape of the ink ejection region R1 in which the ink ejection ports 18*a* are present. In the drawings, to facilitate understanding, the ink (purged ink) 22 is indicated by hatching.

Figure 19:
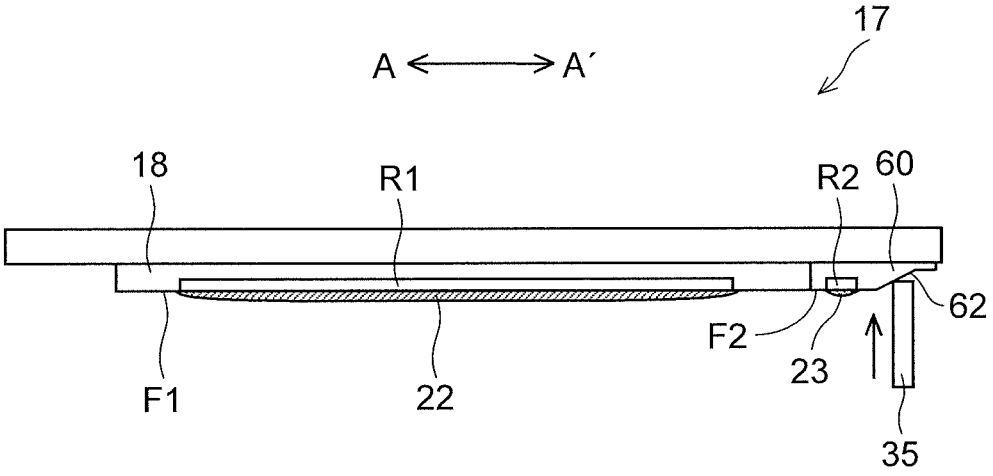
FIG. 19 is a diagram showing a state where, from the state in FIG. 18, the wiper is moved up to be in pressed contact with the cleaning solution feeding member.

Wiping Operation: As shown in FIG. 19, the control portion 110 moves up the wiper 35 to bring it in contact, under a predetermined pressure, with the inclined surface 62 of the cleaning solution feeding member 60 of the recording head 17.

Figure 20:
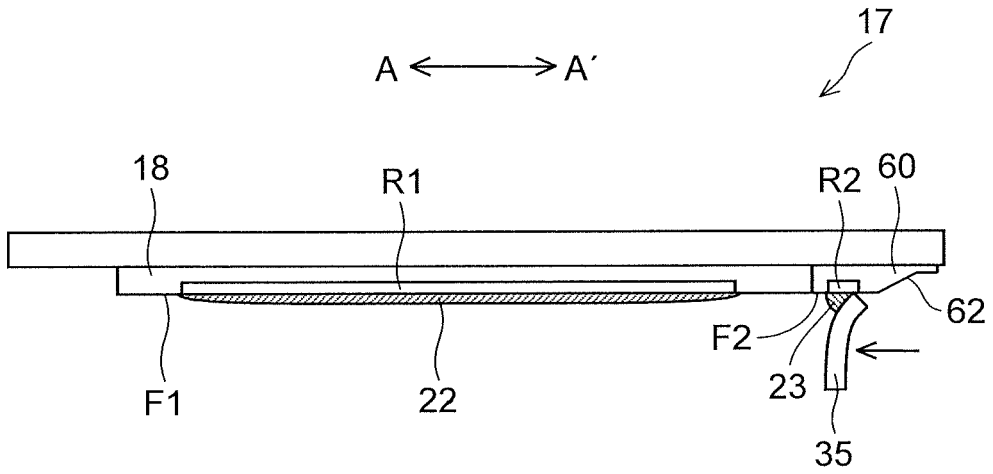
FIG. 20 is a diagram showing a state where, from the state in FIG. 19, the wiper is moved in the direction indicated by arrow A while in pressed contact with the cleaning solution feeding member.

From the state where a tip end of the wiper 35 is kept in pressed contact with the inclined surface 62 of the cleaning solution feeding member 60, the control portion 110 moves the wiper 35, as shown in FIG. 20, along the cleaning solution feed surface F2 toward the ink ejection region R1 (in the direction indicated by arrow A). Thus, the wiper 35 moves, while holding the cleaning solution 23 thereon, toward the ink ejection region R1. Immediately after the wiper 35 has passed the cleaning solution feed region R2, the cleaning solution 23 in the cleaning solution feeding member 60 is brought into the state shown in FIG. 8.

Figure 21:
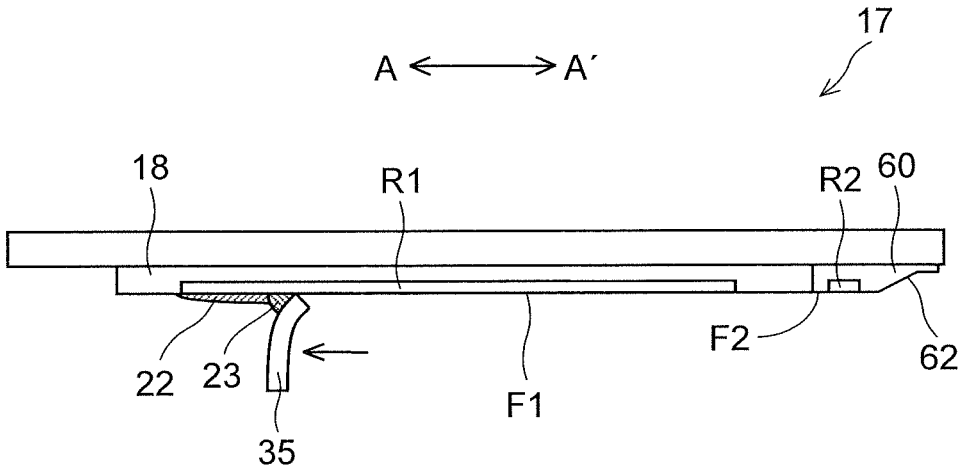
FIG. 21 is a diagram showing a state where, from the state in FIG. 20, the wiper is moved farther in the direction indicated by arrow A.

Then, as shown in FIG. 21, the wiper 35 moves over the ink ejection surface F1 in the leftward direction (the direction indicated by arrow A) while maintaining the state where the cleaning solution 23 is held thereon. Here, by the cleaning solution 23 and the ink (purged ink) 22, ink droplets (waste ink) that have settled and hardened on the ink ejection surface F1 are dissolved, and are then wiped by the wiper 35. Then, the wiper 35 moves farther in the leftward direction (the direction indicated by arrow A), and when reaching a position on the opposite side of the ink ejection region R1 from the cleaning solution feed region R2, the movement in the leftward direction stops. Wiped off by the wiper 35, the cleaning solution 23 and the purged ink 22 forcibly discharged out of the ink ejection ports 18*a* are collected in a cleaning solution collection tray (unillustrated) arranged in the maintenance unit 19.

Figure 22:
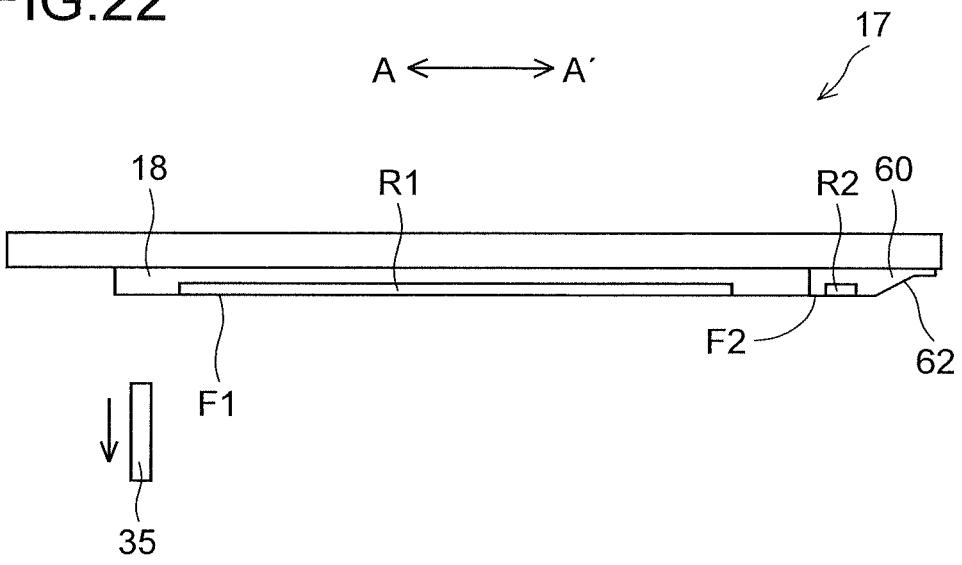
FIG. 22 is a diagram showing a state where, from the state in FIG. 21, after the wiper has been moved farther in the direction indicated by arrow A, the wiper is moved down to be apart from the ink ejection surface.

Separating Operation: After the wiping operation, as shown in FIG. 22, the control portion 110 moves down the wiper 35 to move it away from the ink ejection surface F1.

Non-Feeding Operation: After the wiper 35 has passed the cleaning solution feed region R2 (in the middle of or after the wiping operation), the control portion 110 drives the stepping motor 53 of the lifting mechanism 50 to rotate in the reverse direction by a predetermined amount. Here, the sub-tank 71 is located such that the solution surface of the cleaning solution 23 in the sub-tank 71 is below the first position P1 (here, at a height lower than the first position P1 but equal to or higher than the third position P3). Thus, the cleaning solution 23 is slightly sucked into the cleaning solution feed ports 60*a*, that is, the cleaning solution 23 is brought back into the state shown in FIG. 14.

Finally, the control portion 110 horizontally moves the maintenance unit 19 located between the recording portion 9 and the first conveying unit 5 to locate it under the second conveying unit 12, and moves the first conveying unit 5 up to a predetermined position. This ends the recovery operation of the recording heads 17.

In this embodiment, as described above, the cleaning solution feeding operation where the cleaning solution 23 is fed through the cleaning solution feed ports 60*a* and the wiping operation where the wipers 35 wipe the ink ejection surfaces F1 while holding the cleaning solution 23 thereon are performed. Thus, it is possible to clean the ink ejection surfaces F1.

The non-feeding operation can also be performed where the sub-tank 71 is located such that the solution surface of the cleaning solution 23 in the sub-tank 71 is below the first position P1 so as to prevent the cleaning solution 23 from being fed through the cleaning solution ports 60*a*. Thus, after the recovery processes of the recording heads 17 have been performed, the solution surface of the cleaning solution 23 is formed above the cleaning solution feed ports 60*a*. Thus, even when a sheet S rubs against the recording heads 17, it is possible to prevent the cleaning solution 23 from attaching to the sheet S, and thus to prevent the sheet S from being soiled with it.

As described above, in the cleaning solution feeding operation, the sub-tank 71 is located such that the solution surface of the cleaning solution 23 in the sub-tank 71 is above the second position P2. This makes it possible to easily feed a sufficient amount of the cleaning solution 23.

As described above, in the non-feeding operation, the sub-tank 71 is located such that the solution surface of the cleaning solution 23 in the sub-tank 71 is at a height lower than the first position P1 but equal to or higher than the third position P3. This makes it possible to prevent the cleaning solution 23 from flowing back toward the sub-tank 71, and to form the solution surface of the cleaning solution 23 near the cleaning solution feed port 60*a*. Accordingly, the amount of movement (lifting amount) of the sub-tank 71 for a subsequent recovery operation can be reduced; thus, it is possible to shorten the moving time of the sub-tank 71, and also to feed a proper amount of the cleaning solution 23 through the cleaning solution feed ports 60*a*.

As described above, the lifting mechanism 50 includes the placement board 51 on which the sub-tank 71 is placed, the ball screw 52 which is fitted with the placement board 51 and which extends in the up-down direction, and the stepping motor 53 which drives the ball screw 52 to rotate. This makes it possible to easily move the sub-tank 71 in the up-down direction by a predetermined amount.

It should be understood that the embodiments disclosed herein are in every aspect illustrative and not restrictive. The scope of the present disclosure is defined not by the description of embodiments given above but by the appended claims, and encompasses many modifications and variations made in the sense and scope equivalent to those of the claims.

Figure 23:
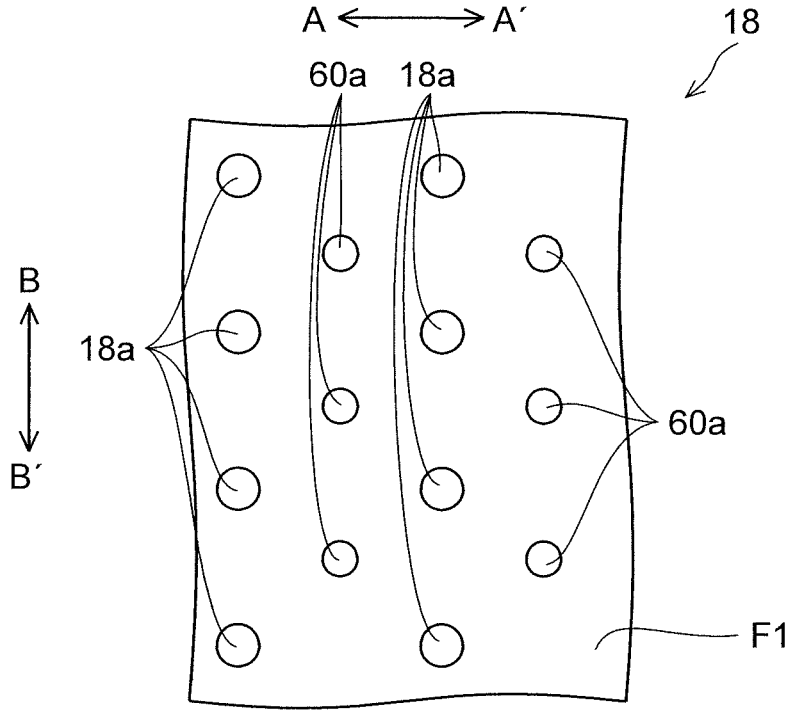
FIG. 23 is a bottom view of a head portion of a recording head according to a modified example of the present disclosure.

For example, although the above-described embodiment deals with an example where the cleaning solution feeding member 60 in which the cleaning solution feed ports 60*a* are formed is provided separately from the head portion 18, this is in no way meant to limit the present disclosure. Instead of the cleaning solution feeding member 60 being provided, the cleaning solution feed ports 60*a* may be formed in the head portion 18. Here, for example, as in the recording head 17 according to a modified example of the present disclosure shown in FIG. 23, the cleaning solution feed ports 60*a* may be arranged next to the ink ejection ports 18*a* (for example, the ink ejection ports 18*a* and the cleaning solution feed ports 60*a* may be alternately arranged).

Although the above-described embodiment deals with an example where two tanks (the sub-tank 71 and the main tank 81) are provided, this is in no way meant to limit the present disclosure; instead, only one tank (only the sub-tank 71) may be provided. In this case, as the recovery operation of the recording heads 17 is repeated, the solution surface of the cleaning solution 23 in the sub-tank 17 gradually lowers. To cope with that, for example, an ultrasonic detection sensor can be provided that can detect the height of the solution surface of the cleaning solution 23 in the sub-tank 71, and the sub-tank 71 can be moved in the up-down direction with consideration also given to variation in the height of the solution surface of the cleaning solution 23 in the sub-tank 71.

Although the above-described embodiment deals with an example where, in the cleaning solution feeding operation, the sub-tank 71 is located such that the solution surface of the cleaning solution 23 in the sub-tank 71 is above the second position P2, this is in no way meant to limit the present disclosure; instead, the sub-tank 71 may be located such that the solution surface of the cleaning solution 23 in the sub-tank 71 is at a height higher than the first position P1 but equal to or lower than the second position P2. In this case, to ensure a sufficient amount of the cleaning solution 23, the number of the cleaning solution feed ports 60*a* may be increased or the inner diameter of the cleaning solution feed ports 60*a* may be increased.

Although the above-described embodiment deals with an example where, in the non-feeding operation, the sub-tank 71 is located such that the solution surface of the cleaning solution 23 in the sub-tank 71 is at a height lower than the first position P1 but equal to or higher than the third position P3, this is in no way meant to limit the present disclosure; instead, the sub-tank 71 may be located such that the solution surface of the cleaning solution 23 in the sub-tank 71 is below the third position P3. In this case, the cleaning solution 23 inconveniently flows back toward the sub-tank 71. Thus, the sub-tank 71 is preferably located such that the solution surface of the cleaning solution 23 in the sub-tank 71 is at a height lower than the first position P1 but equal to or higher than the third position P3.

Although the above-described embodiment deals with an example where the recovery operation of the recording heads 17 is performed by use of the cleaning solution 23 and the ink (purged ink) 22; instead, the recovery operation of the recording heads 17 may be performed by use of the cleaning solution 23 alone. That is, there is no need to perform the ink ejecting operation.

The technical scope of the present disclosure encompasses any structure obtained by combining together different features from the above-described embodiment and modified examples as necessary.

What is claimed is:

1. A recording head recovery system comprising:

a recording head having an ink ejection surface in which a plurality of ink ejection ports through which ink is ejected onto a recording medium are open, and a plurality of cleaning solution feed ports through which cleaning solution is fed, the cleaning solution feed ports being arranged upstream of the ink ejection ports in a wiping direction in which a wiper wipes the ink ejection surface;

a tank which stores cleaning solution to be fed to the cleaning solution feed ports in the recording head, an air pressure in an interior space of the tank being kept equal to an atmospheric pressure;

a cleaning solution feed passage which connects between the tank and the cleaning solution feed ports;

a lifting mechanism which moves the tank in an up-down direction; and a control portion which controls operation of the lifting mechanism, wherein the control portion is able to perform a recovery operation of the recording head including:

a cleaning solution feeding operation where cleaning solution is fed through the cleaning solution feed ports by locating the tank such that a solution surface of the cleaning solution in the tank is above a first position which is a height of the cleaning solution feed ports;

a wiping operation where, after the cleaning solution feeding operation, the wiper wipes the ink ejection surface while holding the cleaning solution thereon; and a non-feeding operation where, in middle of or after the wiping operation, the cleaning solution is sucked into the cleaning solution feed ports by locating the tank such that the solution surface of the cleaning solution in the tank is below the first position.

2. The recording head recovery system of claim 1, wherein when density of the cleaning solution is represented by $\rho$, a surface tension coefficient of the cleaning solution is represented by $\gamma$, gravitational acceleration is represented by g, an inner diameter of the cleaning solution feed ports is represented by $\phi$, an angle of contact of the cleaning solution with respect to a surface in which the cleaning solution feed ports are formed is represented by $\theta$, and a position higher than the first position by $4\gamma\times\sin\theta/(\rho\phi)$ is referred to as a second position, then in the cleaning solution feeding operation, the tank is located such that the solution surface of the cleaning solution in the tank is above the second position.

3. The recording head recovery system of claim 1, wherein when density of the cleaning solution is represented by $\rho$, a surface tension coefficient of the cleaning solution is represented by $\gamma$, gravitational acceleration is represented by g, an inner diameter of the cleaning solution feed ports is represented by $\phi$, and a position lower than the first position by $4\gamma/(\rho g\phi)$ is referred to as a third position, then in the non-feeding operation, the tank is arranged such that the solution surface of the cleaning solution in the tank is at a height equal to or higher than the third position.

4. The recording head recovery system of claim 1, wherein the lifting mechanism includes a placement board on which the tank is placed, a ball screw which is fitted with the placement board and which extends in the up-down direction, and a stepping motor which drives the ball screw to rotate.

5. An inkjet recording apparatus comprising the recording head recovery system of claim 1.

6. A method for recovering a recording head having an ink ejection surface in which a plurality of ink ejection ports through which ink is ejected onto a recording medium are open, and a plurality of cleaning solution feed ports through which cleaning solution is fed, the cleaning solution feed ports being arranged upstream of the ink ejection ports in a wiping direction in which a wiper wipes the ink ejection surface, the method comprising:

a cleaning solution feeding operation where cleaning solution is fed through the cleaning solution feed ports by locating a tank, which stores the cleaning solution to be fed to the cleaning solution feed ports in the recording head, an air pressure in an interior space of the tank being kept equal to an atmospheric pressure, such that a solution surface of the cleaning solution in the tank is above a first position which is a height of the cleaning solution feed ports;

a wiping operation where, after the cleaning solution feeding operation, the wiper wipes the ink ejection surface while holding the cleaning solution thereon; and a non-feeding operation where, in middle of or after the wiping operation, the cleaning solution is sucked into the cleaning solution feed ports by locating the tank such that the solution surface of the cleaning solution in the tank is below the first position.

* * * * *